US008807613B2

(12) United States Patent
Howell et al.

(10) Patent No.: US 8,807,613 B2
(45) Date of Patent: Aug. 19, 2014

(54) CONTAINER GRABBING DEVICE

(75) Inventors: Troy D. Howell, Mantorville, MN (US); Daniel F. Kubista, Pine Island, MN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 69 days.

(21) Appl. No.: 13/598,064

(22) Filed: Aug. 29, 2012

(65) Prior Publication Data

US 2013/0057007 A1 Mar. 7, 2013

Related U.S. Application Data

(60) Provisional application No. 61/530,529, filed on Sep. 2, 2011.

(51) Int. Cl.
*B66C 1/00* (2006.01)
*B66C 1/42* (2006.01)

(52) U.S. Cl.
USPC ..... 294/106; 294/198; 294/902; 414/408

(58) Field of Classification Search
USPC ..... 414/403–404, 406–409, 733; 294/86.4, 294/106, 902, 198
See application file for complete search history.

(56) References Cited

U.S. PATENT DOCUMENTS

| | | | | |
|---|---|---|---|---|
| 3,982,782 | A * | 9/1976 | Bos | 294/189 |
| 4,452,479 | A * | 6/1984 | Terai et al. | 294/198 |
| 4,461,607 | A | 7/1984 | Smith | |
| 4,669,940 | A * | 6/1987 | Englehardt et al. | 414/303 |
| 5,026,104 | A * | 6/1991 | Pickrell | 294/86.4 |
| 5,092,731 | A * | 3/1992 | Jones et al. | 414/406 |
| 5,391,039 | A | 2/1995 | Holtom | |
| 5,398,983 | A | 3/1995 | Ahrens | |
| 5,769,592 | A | 6/1998 | Christenson | |
| 5,863,086 | A | 1/1999 | Christenson | |
| 2010/0183410 | A1 | 7/2010 | Curotto | |

FOREIGN PATENT DOCUMENTS

CA 2262651 4/1997

OTHER PUBLICATIONS

Examiner's Report, CA, Jan. 18, 2013.

* cited by examiner

*Primary Examiner* — Stephen Vu
(74) *Attorney, Agent, or Firm* — Foley & Lardner LLP

(57) ABSTRACT

A mechanized gripping apparatus for grabbing collection containers of a range of sizes is disclosed. The apparatus has converging opposed cylinder-operated finger arrangements which pivot together to close about a container for gripping and open to release a container.

7 Claims, 6 Drawing Sheets

CONTAINER GRABBING DEVICE

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to devices and methods for grabbing, lifting and tipping (unloading) refuse and/or recyclables from collection containers into charging compartments of collection vehicles. More particularly, this invention relates to a grabbing device attached to a deployable arm mounted on a side, front or rear-loading collection vehicle, which allows containers of widely varying shapes and sizes to be efficiently handled during collection efforts. The system coordinates with a packing system contained within the charging hopper of the collection vehicle which may be cycling continuously and repeatedly packing the refuse and/or recyclables.

II. Related Art

Various vehicles dedicated to the collection of refuse or recyclables have included a mechanized material handing device, allowing the operator to grab, lift and empty a container of interest without getting out of the collection vehicle. The holding or grasping device is generally connected to an arm, extensible or offset boom which is connected to a base mounted on the vehicle. The arm or boom and grasping device are operated in concert to engage the container of interest, lift and dump the container into a receiving hopper in the vehicle.

A representative example of such a device appears in U.S. Pat. No. 5,769,592, issued to Christenson and assigned to the same assignee as the present invention, which describes a vehicle-mounted, opposed-finger grabber assembly for grabbing, lifting and dumping refuse containers. That vehicle-mounted grabber assembly is preferably rotatably and pivotally mounted with reference to a material receiving location of a side-loading collection vehicle. The device includes a mechanized swivel mount, an articulated arm, a convergent digital gripping mechanism or grabber with flexible gripping belts and mechanized systems for actuating each of the swivel mount, articulated arm and grabber or grabbing mechanism.

The gripping mechanism of that device includes a support member or frame, gear coordinated first and second opposed mechanized fingers mounted on pivot pins, first and second flexible belts, guide rollers, belt guides and means for simultaneously actuating said first and second fingers using the gear system. The fingers are shaped to fit around containers of a plurality of different shapes, including curved, rectangular, hexagonal and others.

Other devices are described in references that include Holtom (U.S. Pat. No. 5,391,039), which includes a grabbing assembly that uses a plurality of independent actuators to operate. Ahrens (U.S. Pat. No. 5,398,983) discloses a gripping mechanism that includes a frame with a pair of convergent arms pivotally mounted to the frame. A patent to Smith (U.S. Pat. No. 4,461,607) is directed to a gripping apparatus that uses a single hydraulic cylinder and meshing gear segments to operate a pair of converging gripper arms.

SUMMARY OF THE INVENTION

The purpose of the present invention is to provide a grabber device for use with a vehicle-mounted container handling mechanism that includes a grabbing, lifting and dumping mechanism that is mounted with reference to a material receiving location of a collection vehicle. The device includes a convergent digital gripping mechanism or grabber with flexible gripping belts and a mechanized system for actuating the grabber.

The griping mechanism of the present invention includes a support arm member or frame, first and second opposed mechanized fingers, first and second flexible belts, guide rollers, belt guides and means for simultaneously actuating the first and second fingers. The support member is rotationally connected by known means to a mechanized lift and dump mechanism which may be of any compatible type. Each mechanized finger is pivotally connected to the support structure. The fingers are shaped to fit around containers of a plurality of different shapes, including curved, rectangular, hexagonal and others.

The fingers are pivoted between an open or retracted position and a closed or grasping position by a fluid-operated actuator. The fluid-operated actuator, such as a double-acting hydraulic cylinder, is dual trunion-mounted with built-in P.O. checks (both directions). The cylinder may have an adjustable rod end to assist in operating the grabber fingers and is connected to one of the fingers and the support system, whereby actuation of the hydraulic cylinder rotates the connected finger. An opposed linkage member is connected between the proximal ends of the fingers such that actuation of the hydraulic cylinder with the linkage causes both fingers to rotate simultaneously, either converging or diverging with respect to the other. The linkage may be mounted on spherical bearings. A corresponding gripping belt is fastened to each finger to provide a flexible gripping surface and is provided with a guide to reduce the chance of entanglement.

The grabber fingers also have an adjustable belt tension device that is included on each finger which allows the flexibility of fine tuning the grabber to conform to the grabbing of multiple container manufactures cart sizes such as 35, 65, 95, 300 up to 450 gallon containers. This enables positive belt tension on all container sizes without the use of springs. The finger length can also be mechanically or manually adjusted.

In operation, at the beginning of a lift and dump cycle, the articulated arm and gripping mechanism are in an "as stowed" or fully retracted open position. Then the mounting system may be extended to move the gripping mechanism toward the container of interest. The griping device is operated to a closed position converging the fingers together to grab the container. Once the fingers engage the container, the support system is retracted laterally and operated generally vertically to lift and tip or invert the container and empty the contents into a receiving hopper of the collection vehicle.

DETAILED DESCRIPTION

The following description details one or more exemplary embodiments illustrating the present invention. It should be noted that the detailed descriptions are intended by way of example only and are not intended to limit the scope of the invention in any respect. It will be further understood that the embodiments of the invention can be modified by those skilled in the art while remaining in keeping with the inventive concepts.

Figure 1:
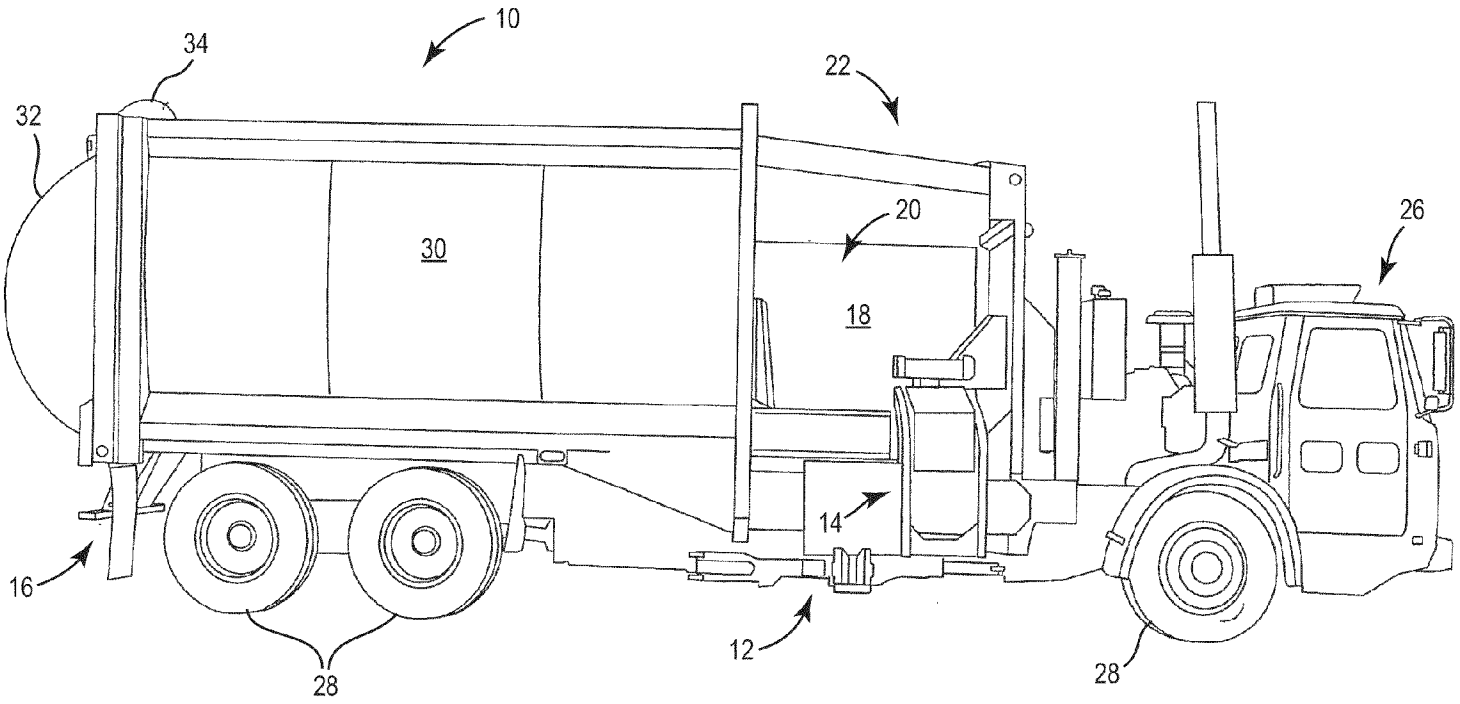
FIG. 1 is a side elevational view of a refuse collection vehicle suitable for using the gripping and lifting device of the invention.

In FIG. 1, there is shown a side-loading refuse vehicle 10 suitable for incorporating the grabbing mechanism of the present invention as shown schematically at 12. A lifting and dumping mechanism is shown at 14. The vehicle 10 includes a chassis 16 and a charging hopper 18 which may have an open side at 20 or top as at 22. The refuse vehicle 10 includes a cab 26 and wheels 28 which carry a storage body 30 connected to the charging hopper 18. Storage body 30 includes a tailgate 32 which is pivotally attached by a pair of vertically displaceable hinges, one of which is shown at 34, mounted at the top of the storage body 30. The tailgate 32 is operated between an open and a closed position by a pair of hydraulic cylinders (not shown), which are pivotally attached to the tailgate 32, and to the storage body 30. Side latches are provided for latching the tailgate 32 to the storage body 30 in a well-known manner. The storage body is designed to tilt in conjunction with the opening of the tailgate to discharge refuse. Tilting is accomplished by a pair of side-mounted hydraulic lift cylinders that are pivotally attached to the frame by a structural member and to the storage body 30.

The grabber device of the invention is best pictured in FIGS. 2A-4B and is shown generally at 100 mounted on a structural arm 102 which may attach at 104 and 106 to extend and lift mechanisms. It will be appreciated that the grabber device may attach to and be positioned by any of many extend lift and dump mechanisms, the grabbing device itself being the focus of the present invention.

Figure 4A:
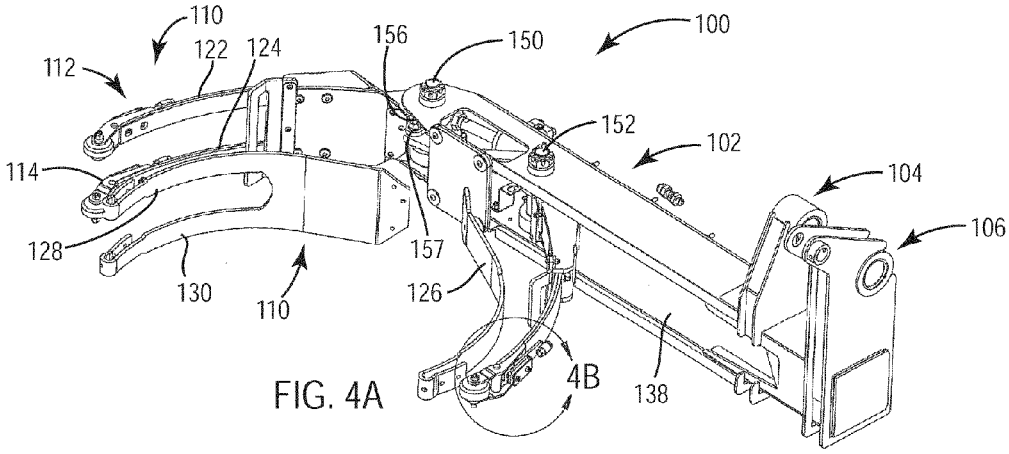
FIG. 4A is a partially exploded view of a grabber similar to that shown in FIGS. 3A, and 3B
Figure 4B:
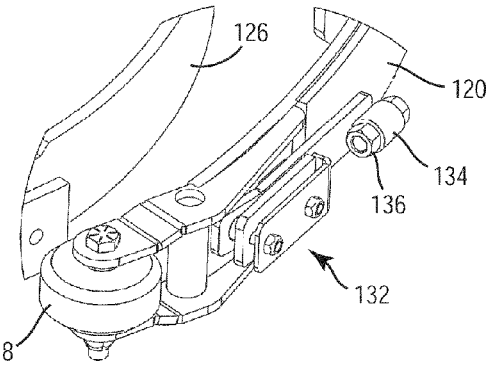
FIG. 4B is an enlarged view of detail A in FIG. 4A.
Figure 5A:
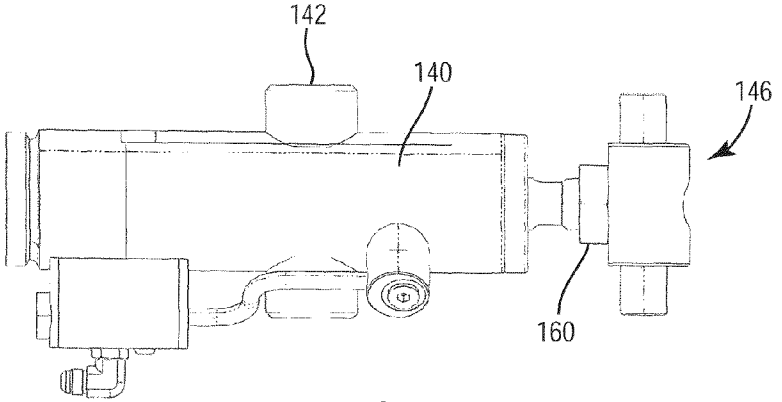
FIGS. 5A-5D are top, side, end and perspective views, respectively of a cylinder suitable to operate the grabbing device of the invention.
Figure 5B:
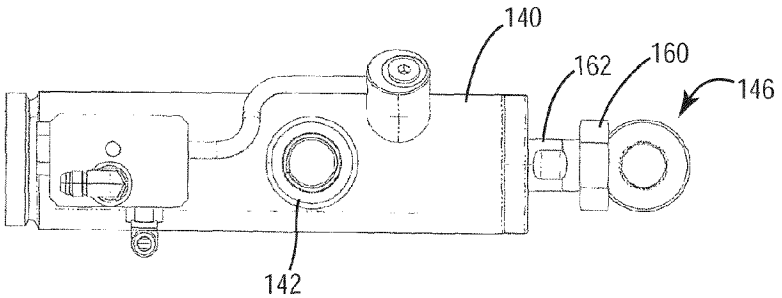
Figure 5C:
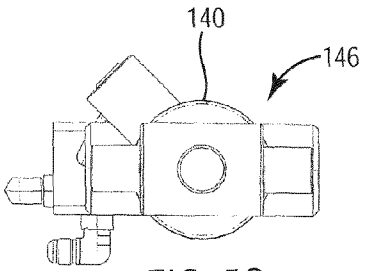
Figure 5D:
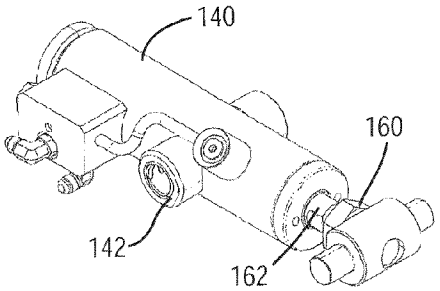

The grabber 100 includes opposed finger elements including a dual digit finger element 110 having digits 112 and 114 and single digit finger element 116. The end of each digit includes a bearing-mounted roller element 118. Each of the digits of the grabber includes a metal element as at 120, 122 and 124, which are provided with corresponding belt elements 126, 128 and 130. As best shown in FIG. 4B, each of the belts is provided with a tension adjustment system, as at 132 (FIG. 4B) that includes an adjusting device 134 which includes an adjustment bolt 136.

Figure 2A:
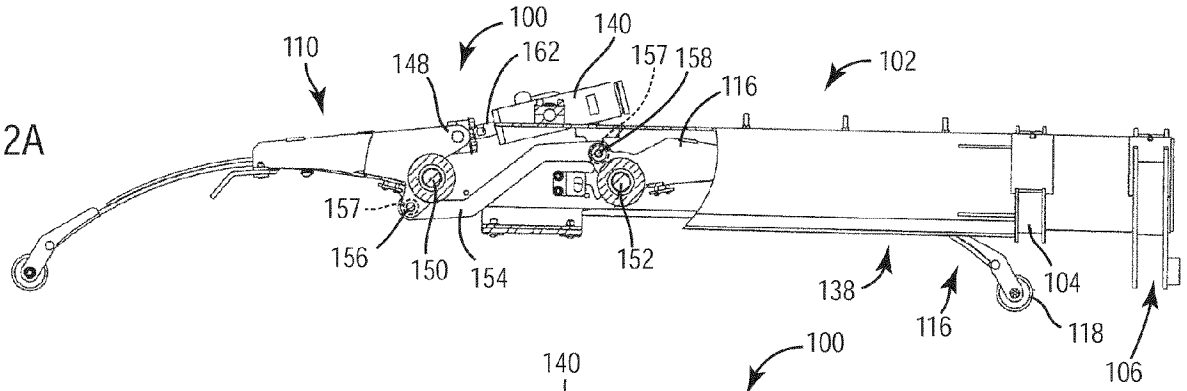
FIGS. 2A and 2B are top views that illustrate a grabber device in accordance with the invention in the fully open or retracted position and the fully closed or grasping position, respectively, with parts removed for clarity.
Figure 2B:
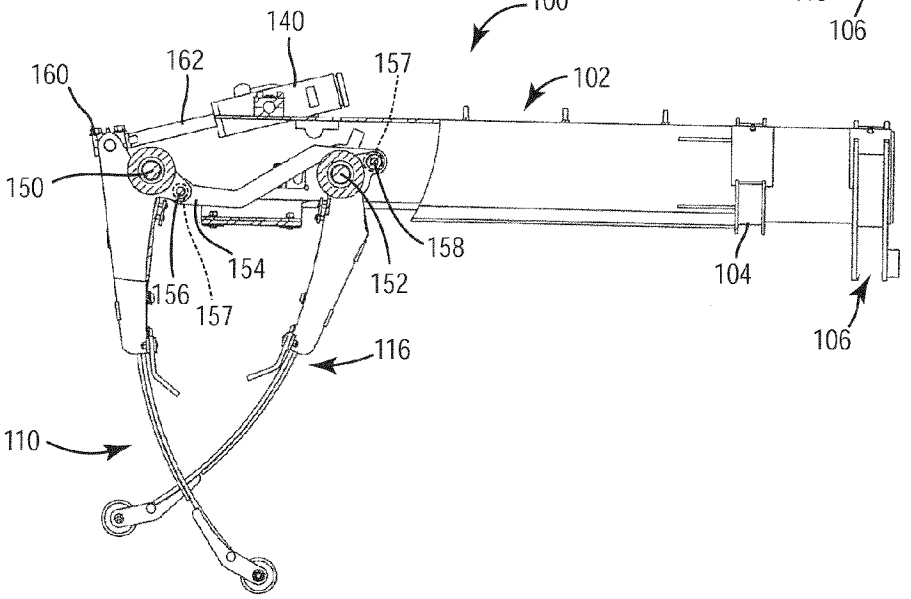
Figure 3A:
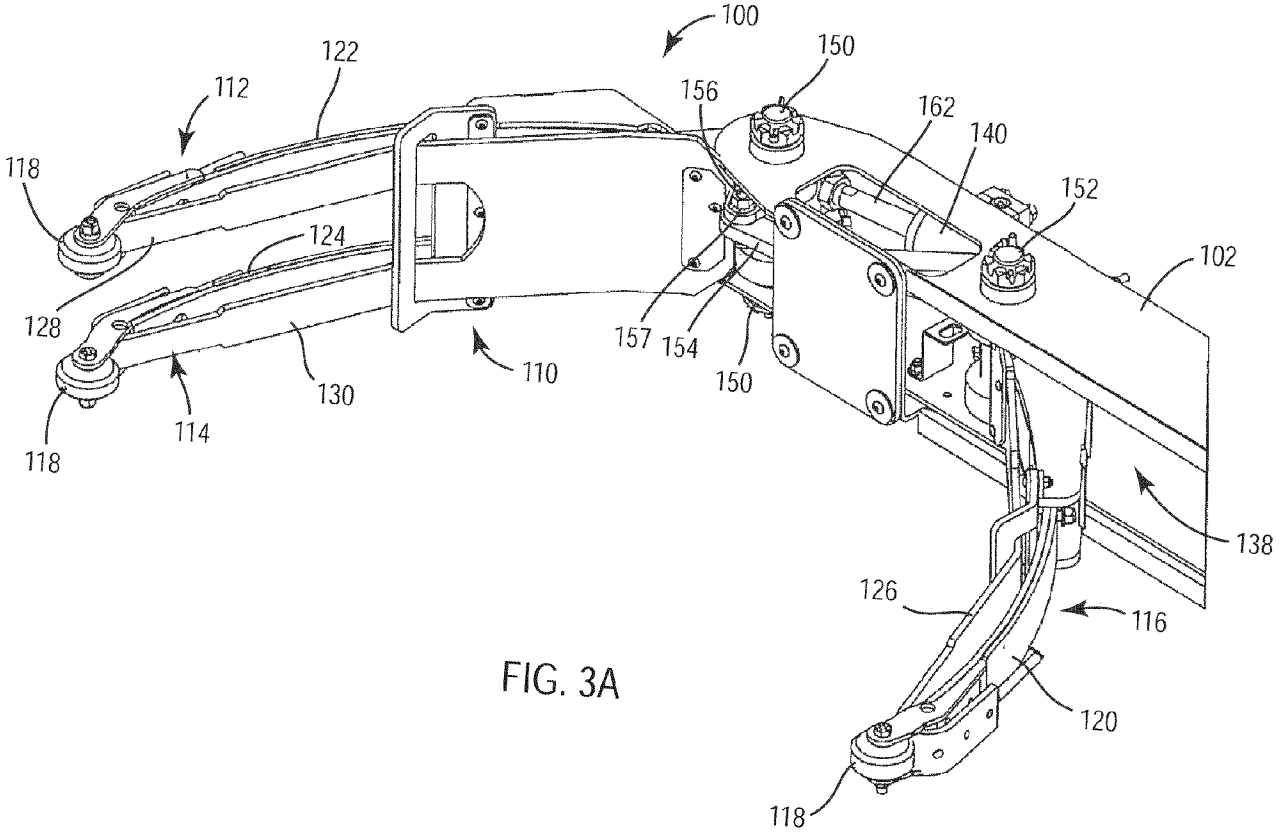
FIG. 3A is a further front perspective view of a grabber device as in FIGS. 2A and 2B.
Figure 3B:
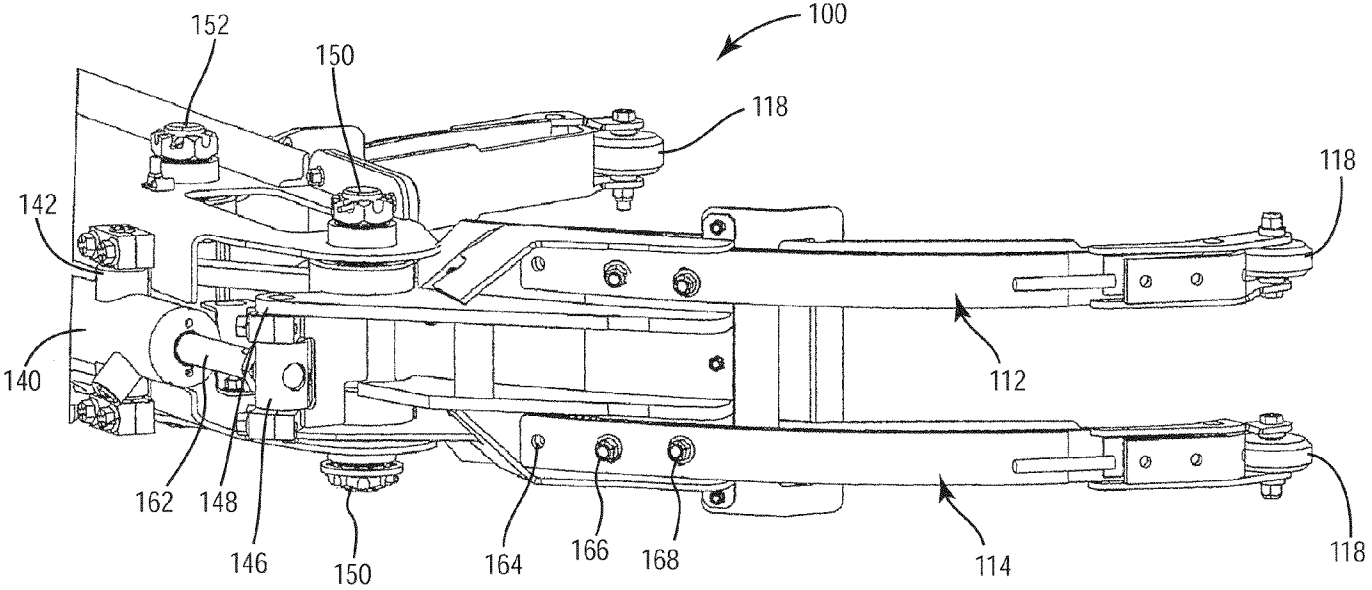
FIG. 3B is an enlarged rear perspective view of the grabber device of FIG. 3A.

The FIG. 2A shows the grabber mechanism in the fully retracted open position which gives the system a very narrow profile with regard to protruding laterally from the side of a refuse vehicle. In this manner, the single digit finger element 116 resides in a recess or hollow channel cavity 138 in the structural arm 102 when the grabber is fully retracted or stowed.

The grabber further includes a double-acting fluid cylinder (preferably hydraulic, but a pneumatic device could be used) 140 that is mounted on the structural arm 102 by a trunion at 142 (FIGS. 3B, 5A-5D). The rod end is adjustable and is connected using a trunion mount 146 to the end of digit finger element 110 at a pivot joint 148. The finger element 110 is pivotally mounted to swivel about pivot joint 150 and the finger element 116 is pivotally mounted to swivel about pivot joint 152. These joints extend to top and bottom members of structural arm 102. The elements 110 and 116 are connected by opposing linkage member 154 (FIGS. 2A and 2B) which is pivotally connected to the finger element 110 at 156 and is pivotally connected to the finger element 116 at 158. According to the exemplary embodiment shown in FIGS. 2A, 2B, 3A, and 4B, these connections include spherical bearings 157. An adjustment element 160 is provided that allows adjustment of the cylinder rod 162 that allows for adjustment of the grabber. The grabber finger geometry and fastening technique as shown by the series of spaced openings at 164, 166, and 168 which allow finger length adjustment allows the fingers to be extended without replacing the main fingers. The system can operate with any desired hydraulic system controls that allows for adjustment of pressure and flow as desired.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A gripping apparatus for grabbing collection containers, said gripping apparatus comprising:

(a) first and second opposed mechanized fingers, each having a proximal end and a distal end, said proximal end of each finger being pivotally connected to a support assembly, said first and second fingers being aligned in spaced relation and disposed to converge and diverge to grasp and release an object of interest;

(b) a first flexible element having a proximal end attached to the proximal end of said first finger and further having a distal end attached adjacent the distal end of said first finger;

(c) a second flexible element having a proximal end attached to the proximal end of said second finger and further having a distal end attached adjacent the distal end of said second finger;

(d) a trunion-mounted fluid cylinder connected to pivot said first one of said opposed mechanized fingers and a linkage member mounted on spherical bearings to the first and the second opposed mechanized fingers, wherein the linkage member is operable by the pivoting of said first mechanized finger and connects the opposed mechanized fingers together such that the first and second opposed mechanical fingers converge and diverge in unison with the operation of said cylinder; and (e) a support assembly for carrying said gripping apparatus in offset cantilevered relation to a lift and dump mechanism.

2. A gripping apparatus as in claim 1 wherein said fluid cylinder is a double-acting hydraulic cylinder.

3. A gripping apparatus as in claim 1 wherein said fluid cylinder has an adjustable rod end.

4. A gripping apparatus as in claim 1 wherein said support assembly includes a recess that accommodates a mechanized finger when the gripper is stowed.

5. A gripping apparatus as in claim 1 wherein the length of said fingers is adjustable to accommodate a variety of container sizes.

6. A gripping apparatus as in claim 1 wherein said flexible elements comprise gripping belts associated with each finger and further comprising a mechanism for adjusting the tension in the belts.

7. A gripping apparatus as in claim 1 wherein the fingers include bearing-mounted end rollers.

* * * * *